US010991293B2

(12) United States Patent
Lee

(10) Patent No.: US 10,991,293 B2
(45) Date of Patent: Apr. 27, 2021

(54) SOURCE DRIVER FOR DISPLAY APPARATUS

(71) Applicant: SILICON WORKS CO., LTD., Daejeon (KR)

(72) Inventor: Jae Kwan Lee, Seoul (KR)

(73) Assignee: Silicon Works Co., Ltd., Daejeon-si (KR)

( * ) Notice: Subject to any disclaimer, the term of this patent is extended or adjusted under 35 U.S.C. 154(b) by 0 days.

(21) Appl. No.: 16/592,493

(22) Filed: Oct. 3, 2019

(65) Prior Publication Data

US 2020/0035143 A1 Jan. 30, 2020

Related U.S. Application Data

(62) Division of application No. 15/409,732, filed on Jan. 19, 2017, now Pat. No. 10,467,942.

(30) Foreign Application Priority Data

Jan. 21, 2016 (KR) ..... 10-2016-0007314
Jan. 17, 2017 (KR) ..... 10-2017-0007897

(51) Int. Cl.
*G09G 3/20* (2006.01)
*G09G 3/32* (2016.01)
*G09G 3/36* (2006.01)

(52) U.S. Cl.
CPC ..... *G09G 3/2007* (2013.01); *G09G 3/32* (2013.01); *G09G 3/3688* (2013.01); *G09G 2310/0291* (2013.01); *G09G 2320/0673* (2013.01)

(58) Field of Classification Search
CPC ..... G09G 3/2007; G09G 3/32; G09G 3/3688; G09G 2310/0291; G09G 2320/0673
See application file for complete search history.

(56) References Cited

U.S. PATENT DOCUMENTS

| | | | | |
|---|---|---|---|---|
| 8,797,201 | B2 | 8/2014 | Huang et al. | |
| 2005/0184978 | A1 | 8/2005 | Bu et al. | |
| 2006/0023001 | A1* | 2/2006 | Sung | G09G 3/3688 345/690 |
| 2014/0139364 | A1 | 5/2014 | Huang et al. | |

FOREIGN PATENT DOCUMENTS

| | | |
|---|---|---|
| CN | 101901586 A | 12/2010 |
| CN | 104050937 A | 9/2014 |
| KR | 10-2002-7005928 | 10/2002 |
| KR | 10-2015-0069589 | 8/2015 |
| KR | 10-2016-0082738 | 7/2016 |

OTHER PUBLICATIONS

English abstract of KR100604918; retrieved from www.espacenet.com on Aug. 8, 2019.

* cited by examiner

*Primary Examiner* — Wing H Chow
(74) *Attorney, Agent, or Firm* — Polsinelli PC

(57) ABSTRACT

The present invention relates to a source driver for a display apparatus, which is capable of removing delay of a DAC (Digital-Analog Converter) and in which a part of gamma lines for providing gamma voltages to the DAC is designed to have a large width and a small resistance value. Before driving a first gamma voltage to a level corresponding to display data, the DAC can select an adjacent gamma line having a small resistance value and drive a second gamma voltage, thereby removing a delay time.

9 Claims, 7 Drawing Sheets

SOURCE DRIVER FOR DISPLAY APPARATUS

CROSS-REFERENCE TO RELATED APPLICATION(S)

This application is a divisional of U.S. application Ser. No. 15/409,732, Filed Jan. 19, 2017 and entitled "SOURCE DRIVER FOR DISPLAY APPARATUS", the entirety of which is incorporated herein by reference in its entirety.

BACKGROUND

1. Technical Field

The present disclosure relates a source driver, and more particularly, to a source driver for a display apparatus, which is capable of removing output delay of a DAC (Digital-Analog Converter).

2. Related Art

A flat panel display apparatus includes a source driver that provides a source signal to display on a display panel. The source driver provides a source signal to the display panel, the source signal corresponding to display data provided from an external source.

The display panel may include an LCD (Liquid Crystal Display) panel or LED (Light Emitting Diode) panel. The LCD panel displays a screen using an optical shutter operation of liquid crystal at each pixel, and the LED panel displays a screen using light emission of an LED at each pixel.

Recently, display apparatuses have been required to have high resolution. However, the increase of resolution may reduce a driving time for each pixel or horizontal line. Therefore, in order to compensate for a short driving time, the source driver must remove output delay or particularly output delay of a DAC. However, it is difficult to design a source driver capable of removing output delay.

In particular, the delay time of the source driver or DAC must be overcome in an IC (Integrated Circuit), apart from a load of the display panel.

SUMMARY

Various embodiments are directed to a source driver for a display apparatus, which includes gamma lines of which a part is designed to have a large width having a small resistance value, and is capable of removing output delay of a DAC included therein, using a gamma line having a small resistance value.

Also, various embodiments are directed to a source driver for a display apparatus, in which one of gamma lines included in one group is configured to have a small resistance value and which coarsely drives the gamma line having a small resistance value and then finely drives a gamma voltage corresponding to display data, thereby removing output delay of a DAC.

Also, various embodiments are directed to a source driver for a display apparatus, which coarsely drives a specific level of interpolated voltage using reference gamma voltages corresponding to a group corresponding to display data and then finely drives a gamma voltage corresponding to display data, thereby removing output delay of a DAC.

In an embodiment, a source driver for a display apparatus may include: a decoder connected to a plurality of gamma lines to provide gamma voltages, and configured to select and drive a first gamma voltage corresponding to display data; and a buffer configured to drive the first gamma voltage of the decoder and output the driven voltage as a source voltage. Among the plurality of gamma lines, a plurality of gamma lines to provide gamma voltages corresponding to consecutive gray values may be divided into one group, a second gamma line among the plurality of gamma lines included in the group may have a larger line width than the other gamma lines and thus have a smaller resistance value than the other gamma lines, and the decoder may select and drive a second gamma voltage of the second gamma line in response to the display data corresponding to the group, and then select and drive the first gamma voltage of a first gamma line corresponding to the display data.

In another embodiment, a source driver for a display apparatus may include: a decoder connected to a plurality of gamma lines to provide gamma voltages, and configured to select and drive a first gamma voltage corresponding to display data; and a buffer configured to drive the first gamma voltage of the decoder and output the driven voltage as a source voltage. Among the plurality of gamma lines, a plurality of gamma lines to provide gamma voltages corresponding to consecutive gray values may be divided into one group, a second gamma line among the plurality of gamma lines included in the group may have a larger line width than the other gamma lines and thus have a smaller resistance value than the other gamma lines, and the decoder may select and drive a second gamma voltage of the second gamma line in response to the display data corresponding to the group, and then select and drive the first gamma voltage of a first gamma line corresponding to the display data.

In another embodiment, a source driver for a display apparatus may include: a decoder connected to a first group of gamma lines to provide gamma voltages corresponding to consecutive gray values in a first range and a second group of reference gamma lines to provide reference gamma voltages in a second range different from the first range, including a plurality of transmission lines, and configured to decide a first gamma voltage corresponding to display data; and a buffer configured to drive the first gamma voltage applied through the plurality of transmission lines and output the driven voltage as a source voltage. A second gamma line among the plurality of gamma lines included in the first group may have a larger line width than the other gamma lines and thus has a smaller resistance value than the other gamma lines, and the decoder may drive the second gamma voltage by providing a second gamma voltage of the second gamma line to the plurality of transmission lines in response to the display data corresponding to the first range, drive the first gamma voltage by providing the first gamma voltage of the first gamma line corresponding to the display data to the plurality of transmission lines, and decide the first gamma voltage by providing a first reference gamma voltage to the plurality of transmission lines or distributing and providing the first reference gamma voltage and a second reference gamma voltage to the plurality of transmission lines in response to the display data corresponding to the second range, the second reference gamma voltage having a higher gray level than the first reference gamma voltage.

According to the embodiments of the present invention, a part of the gamma lines to transmit gamma voltages may be designed to have a large width and a small resistance value, and the gamma line having a small resistance value may be driven before a gamma voltage corresponding to display data is driven. Thus, the DAC can rapidly drive the gamma voltage corresponding to the display data and remove output delay of the source driver.

Furthermore, the DAC which selects a gamma voltage corresponding to display data may coarsely drive a gamma line having a small resistance value among gamma lines included in one group, and then finely drive the gamma voltage corresponding to the display data, thereby removing output delay of the DAC and the source driver.

Furthermore, the DAC which selects a gamma voltage corresponding to display data coarsely drives a specific level of interpolated voltage using reference gamma voltages, and then finely drives the gamma voltage corresponding to the display data, thereby removing output delay of the DAC and the source driver.

DETAILED DESCRIPTION

Figure 1:
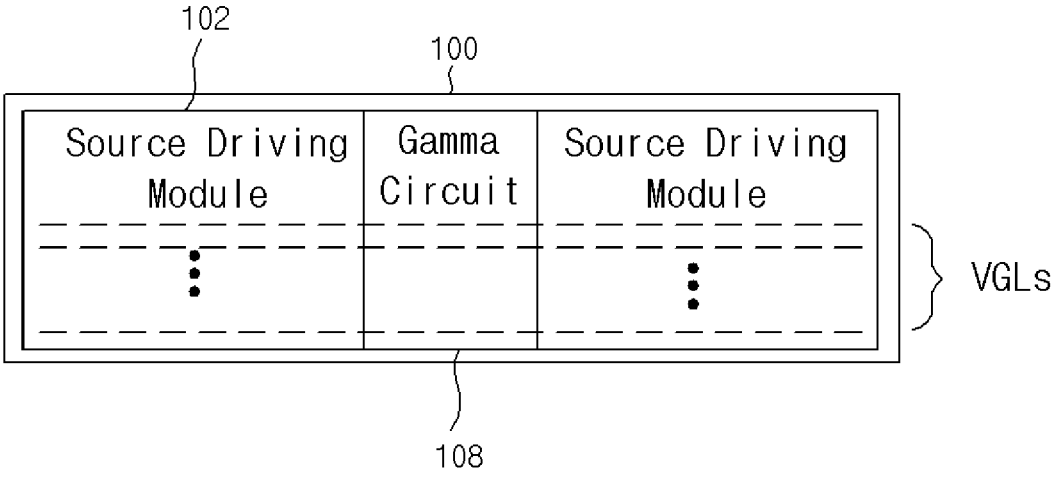
FIG. 1 is a diagram illustrating a source driver according to an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

A source driver 100 for a display apparatus receives display data from an external source (not illustrated), generates source signals corresponding to the display data, and outputs the source signals through a plurality of channels.

Referring to FIG. 1, the source driver 100 includes a source driving module 102 and a gamma circuit 108, and is fabricated as one chip. The source driver 100 may be designed in such a manner that the gamma circuit 108 is arranged at the center of the chip and the source driving modules 102 are arranged at both sides of the gamma circuit 108.

The source driving module 102 outputs a source signal by selecting and driving a gamma voltage corresponding to display data among gamma voltages provided from the gamma circuit 108. For this operation, the source driving module 102 includes a latch, a level shifter, a DAC (Digital-Analog Converter) and an output buffer.

The latch serves to latch display data containing multiple bits inputted in series, and provide the latched data in parallel, and the level shifter serves to adjust the level of the display data according to the input specification of the DAC.

The DAC serves to selects a gamma voltage corresponding to the display data DATA<7:0> and output the selected gamma voltage to the output buffer. The DAC will be described later with reference to FIG. 2.

The output buffer serves to provide a source voltage from the DAC to the display panel.

The latch, the DAC and the output buffer are implemented for each channel of the source driver, and a source voltage is outputted to the display panel through each channel.

The gamma circuit 108 provides gamma voltages corresponding to display data to the source driving modules 102 at both sides thereof, and the gamma voltages are provided to the whole channels of the source driving module 102 through gamma lines VGLs formed across the gamma circuit 108 and the source driving modules 102.

Figure 2:
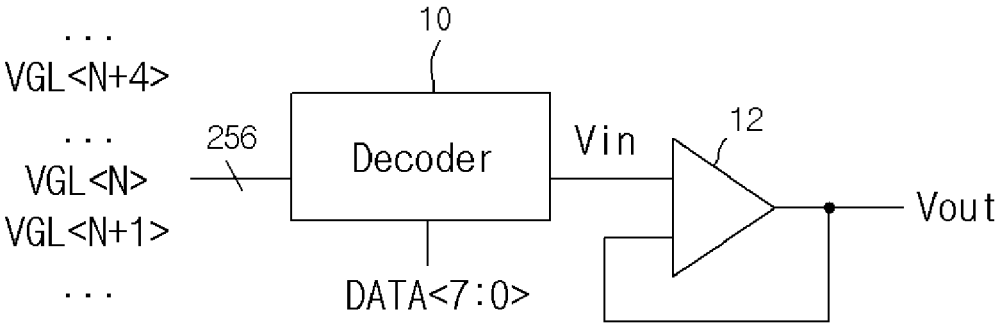
FIG. 2 is a circuit diagram illustrating a DAC of a source driving module according to the embodiment of the present invention.
Figure 3:
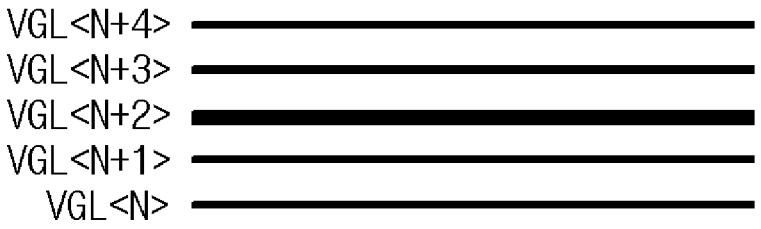
FIG. 3 is a diagram illustrating a layout of gamma lines applied to the embodiment of FIG. 2.
Figure 8:
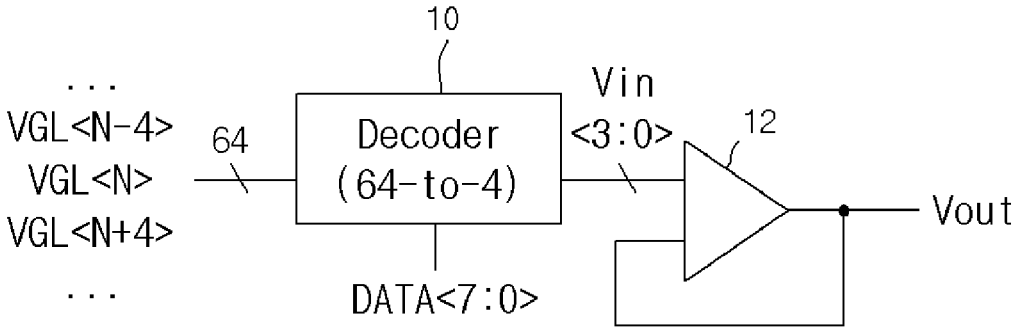
FIG. 8 is a circuit diagram illustrating a DAC of a source driving module according to another embodiment of the present invention.
Figure 9:
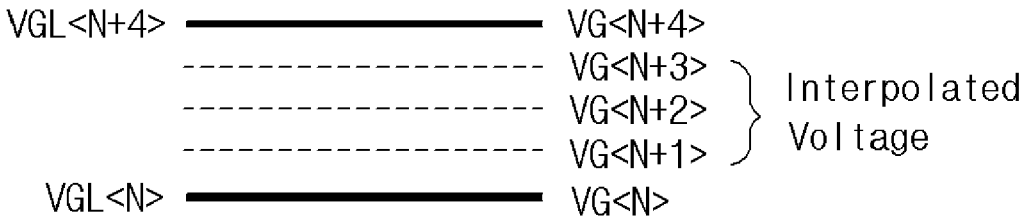
FIG. 9 is a diagram for describing an interpolated voltage and layout of gamma lines applied to the embodiment of FIG. 8.

The gamma circuit 108 provides gamma voltages for gray levels. For example, when 256 gray levels are set, 256 gamma voltages for expressing the 256 gray levels are provided from the gamma circuit 108 to the source driving module 102 through the gamma lines VGLs as illustrated in FIGS. 2 and 3. In contrast, 64 reference gamma voltages for expressing 256 gray levels may be provided from the gamma circuit 108 to the source driving module 102 through the gamma lines VGLs as illustrated in FIGS. 8 and 9.

The embodiment of FIGS. 2 and 3 is based on the supposition that 256 gamma voltages are provided to the DAC included in the source driving module 102. FIG. 2 exemplifies a DAC including a decoder 10 and a buffer 12.

In FIG. 2, the decoder 10 is configured to receive gamma voltages . . . , VG<M+4>, . . . VG<N>, VG<N−1>, . . . through a plurality of gamma lines . . . , VGL<M+4>, VGL<N>, VGL<N−1>, . . . , and select and drive a gamma voltage Vin corresponding to the display data DATA<7:0>. The buffer 12 is configured to drive the gamma voltage Vin and output the driven voltage as a source voltage Vout.

FIG. 3 illustrates four gamma lines VGL<N+3>, VGL<N+2>, VGL<N+1> and VGL<N> which correspond to consecutive gray values and are divided into one group, among the plurality of gamma lines . . . , VGL<M+4>, VGL<N>, VGL<N−1>, . . . , and the four gamma lines VGL<N+3>, VGL<N+2>, VGL<N+1> and VGL<N> provide four gamma voltages VG<N+3>, VG<N+2>, VG<N+1> and VG<N>.

Among the plurality of gamma lines VGL<N+3>, VGL<N+2>, VGL<N+1> and VGL<N> included in one group, the gamma line VGL<N+2> has a larger line width than the other gamma lines VGL<N+3>, VGL<N+1> and VGL<N> as illustrated in FIG. 3. Thus, the gamma line VGL<N+2> has a smaller resistance value than the other gamma lines VGL<N+3>, VGL<N+1> and VGL<N>. The other gamma lines VGL<N+3>, VGL<N+1> and VGL<N> are designed to have the same width while having a smaller width than the gamma line VGL<N+2>.

In the present embodiment, the plurality of gamma lines . . . , VGL<M+4>, VGL<N>, VGL<N−1>, . . . may be divided into a plurality of groups, and each of the groups may include one gamma line having a larger line width than the other gamma lines.

According to the above-described configuration, the decoder 10 selects and drives the gamma voltage VG<N+2> of the gamma line VGL<N+2> in a group corresponding to the display data DATA<7:0>, and then selects and drives a gamma voltage of a gamma line corresponding to the display data DATA<7:0>.

The display data DATA<7:0> may include coarse data and fine data. For example, high-order five bits DATA<7:2> of the display data DATA<7:0> may be defined as the coarse data, and low-order two bits DATA<1:0> may be defined as the fine data. The 5-bit coarse data may divide 256 gamma lines into 64 groups.

The decoder 10 may select a group according to the coarse data DATA<7:2>, and select specific voltages included in the group according to the fine data DATA<1:0>. The 2-bit fine data may divide the four gamma lines included in the group.

Figure 4:
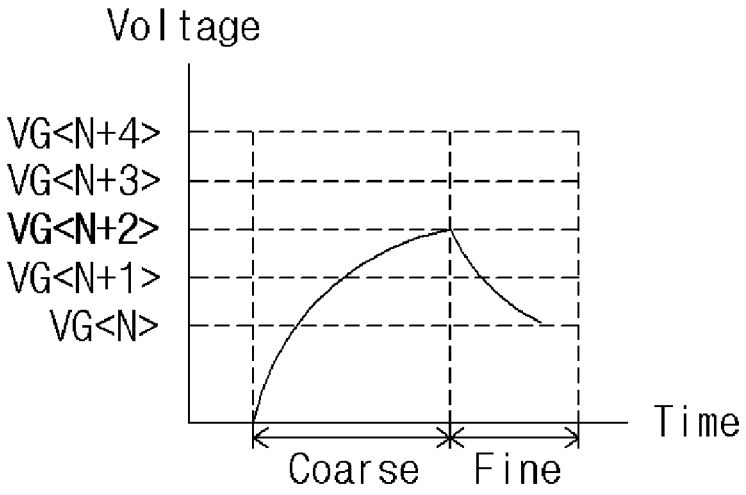
FIGS. 4 to 7 are diagrams for describing a method for driving a gamma voltage according to the embodiment of FIG. 2.

Referring to FIG. 4, the operation of the decoder 10 to select and output the gamma voltage VG<N> in response to the display data DATA<7:0> will be described.

The decoder 10 recognizes the coarse data DATA<7:2> when the data DATA<7:0> are inputted, selects the gamma voltage VG<N+2> of the gamma line VGL<N+2> having a small resistance value and a large width, among the gamma lines VGL<N+3>, VGL<N+2>, VGL<N+1> and VGL<N> included in a group corresponding to the coarse data DATA<7:2>, and drives the gamma voltage Vin to the gamma voltage VG<N+2>. This phase is defined as a coarse phase. The gamma voltage selected by the decoder 10 at the coarse phase may be understood as a second gamma voltage.

After a predetermined time has elapsed, the decoder 10 selects the gamma voltage VG<N> of the gamma line VGL<N> corresponding to the fine data DATA<1:0>, and drives the gamma voltage Vin to the gamma voltage VG<N>. This phase is defined as a fine phase. The gamma voltage selected by the decoder 10 at the fine phase may be understood as a first gamma voltage.

Since the gamma voltage VG<N+2> selected by the decoder 10 at the coarse phase is provided through the gamma line VGL<N+2> having a small resistance value, the gamma voltage VG<N+2> can rise within a short time.

Therefore, the decoder 10 may be coarsely driven to the gamma voltage VG<N+2> within a short time at the coarse phase, and then finely driven to the gamma voltage VG<N> at the fine phase. Thus, the gamma voltage Vin can reach the target level within a shorter time than when only the gamma voltage VG<N> of the gamma line VGL<N> having a large resistance value is driven.

Figure 5:
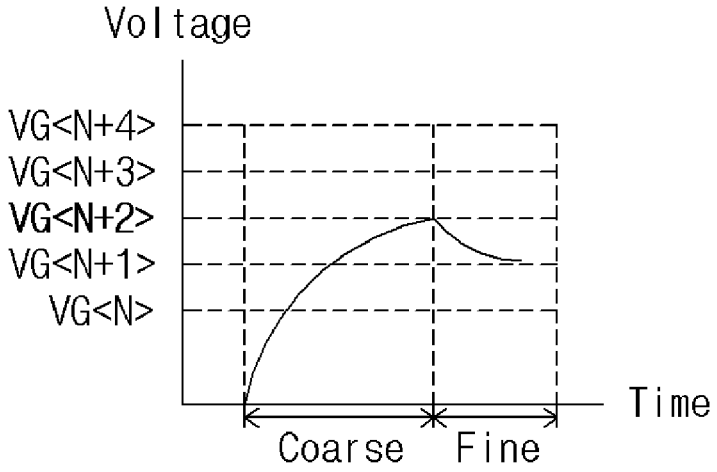
Figure 6:
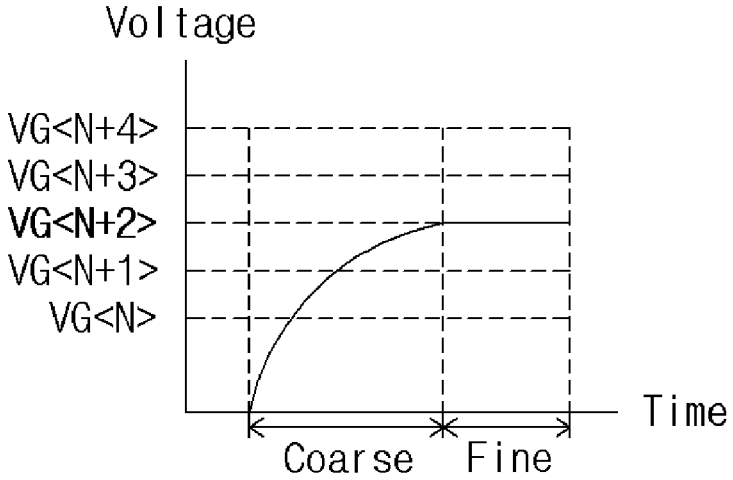
Figure 7:
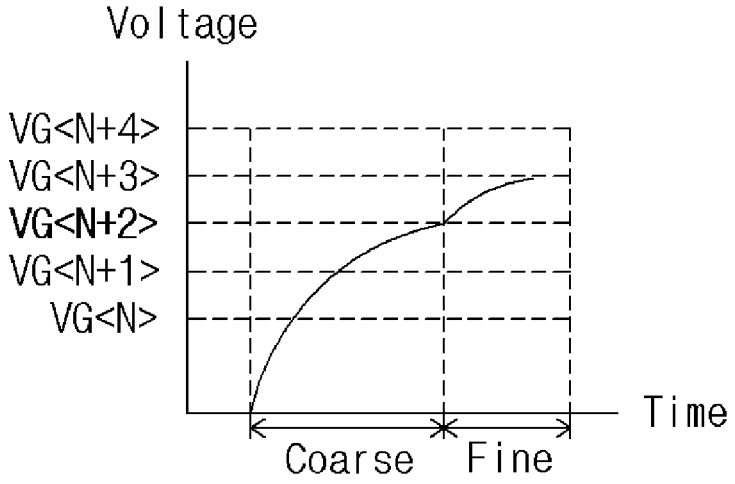

FIG. 5 illustrates coarse and fine operations for selecting and outputting the gamma voltage VG<N+1> through the decoder 10 according to the embodiment of the present invention. FIG. 6 illustrates coarse and fine operations for selecting and outputting the gamma voltage VG<N+2> through the decoder 10 according to the embodiment of the present invention. FIG. 7 illustrates coarse and fine operations for selecting and outputting the gamma voltage VG<N+3> through the decoder 10 according to the embodiment of the present invention.

Referring to FIGS. 5 to 7, the decoder 10 according to the embodiment of the present invention raises the gamma voltage Vin to the gamma voltage VG<N+2> at the coarse phase while having a short delay time, and lowers or raises the gamma voltage VG<N+2> to the gamma voltages VG<N+1> and VG<N+3> as target voltages or retains the gamma voltage VG<N+2> at the fine phase.

According to the present embodiment, the source driver can reduce the delay time required until the gamma voltage Vin inputted to the buffer 12 rises to the voltage level corresponding to the data DATA<7:0>.

Therefore, when the source driver and the DAC of the source driver are applied to a high-resolution display apparatus which requires a short driving time for each pixel or horizontal line, the source driver can output the output signal Vout with a short delay time.

Furthermore, the present invention may be embodied as illustrated in FIGS. 8 and 9, in order to improve the output delay of the DAC when 64 reference gamma voltages corresponding to 256 gray levels are provided from the gamma circuit 108 to the source driving module 102 through the reference gamma lines.

For this operation, the decoder 10 is connected to 64 reference gamma lines . . . , VGL<N+4>, VGL<N>, VGL<N−4>, . . . to receive the 64 reference gamma voltages, and includes four transmission lines Vin<3:0>.

The decoder 10 may provide a first reference gamma voltage to the plurality of transmission lines in response to the display data DATA<7:0> or distribute and provide the first reference gamma voltage and a second reference gamma voltage to the plurality of transmission lines, the second reference gamma voltage having a higher gray level than the first reference voltage gamma voltage, thereby deciding a first gamma voltage transmitted to the buffer 12 through the four transmission lines Vin<3:0>.

In the embodiment of FIGS. 8 and 9, the first and second reference gamma voltages may be defined as voltages having adjacent gray values, and the first reference gamma voltage may be defined as a voltage having a gray value which is lower by one level than the second reference gamma voltage. For example, when the gamma voltage VG<N> is used as the first reference gamma voltage, the gamma voltage VG<N+4> may be understood as the second reference gamma voltage.

In the embodiment of FIGS. 8 and 9, a gamma voltage applied to the input side of the buffer 12 at the coarse phase may be defined as a second gamma voltage, and a gamma voltage applied to the input side of the buffer 12 at the fine phase may be defined as the first gamma voltage.

The buffer 12 drives the first gamma voltage applied through the four transmission lines Vin<3:0> and outputs the driven voltage as a source voltage Vout.

In order to decide the gamma voltage applied to the buffer 12, the decoder 10 may transmit the first reference gamma voltage to the four transmission lines Vin<3:0> in common or distribute and transmit the first reference gamma voltage and the second reference gamma voltage to the four transmission lines Vin<3:0>.

At this time, with the increase in gray level of the gamma voltage, the decoder 10 may increase the number of transmission lines for outputting the second reference gamma voltage.

This configuration will be described with reference to Table 1 below.

TABLE 1

| Vout | Vin<3> | Vin<2> | Vin<1 > | Vin<0> | DATA<7:0> MSB | LSB |
|---|---|---|---|---|---|---|
| VG<N> | VG<N> | VG<N> | VG<N> | VG<N> | XXXXX | 00 |
| VG<N + 1 > | VG<N> | VG<N> | VG<N> | VG<N + 4> | XXXXX | 01 |
| VG<N + 2> | VG<N> | VG<N> | VG<N + 4> | VG<N + 4> | XXXXX | 10 |
| VG<N + 3> | VG<N> | VG<N + 4> | VG<N + 4> | VG<N + 4> | XXXXX | 11 |
| VG<N + 4> | VG<N + 4> | VG<N + 4> | VG<N + 4> | VG<N + 4> | XXXXY | 00 |

In Table 1, interpolated voltages to be formed between the first reference gamma voltage VG<N> and the second reference gamma voltage VG<N+4> are defined as VG<N+1>, VG<N+2> and VG<N+3>. In order for the buffer 12 to output the first reference gamma voltage VG<N> as the source voltage Vout, the decoder 10 provides the first reference gamma voltage VG<N> to each of the four transmission lines Vin<3:0>.

Furthermore, in order for the buffer 12 to output the interpolated voltage VG<N+1> as the source voltage Vout, the decoder 10 provides the first reference gamma voltage VG<N> to three transmission lines Vin<3>, Vin<2> and Vin<1>, and provides the second reference gamma voltage VG<N+4> to one transmission line Vin<0>. The voltage applied to the buffer 12 may be set to an average of the voltages distributed and supplied to the four transmission lines Vin<3:0>. As a result, the interpolated voltage V<N+1> may be applied to the buffer 12, and the buffer 12 may drive the interpolated voltage V<N+1> to output as the source voltage Vout.

Furthermore, in order for the buffer 12 to output the interpolated voltage VG<N+2> as the source voltage Vout, the decoder 10 provides the first reference gamma voltage VG<N> to two transmission lines Vin<3> and Vin<2>, and provides the second reference gamma voltage VG<N+4> to two transmission lines Vin<1> and Vin<0>. As a result, the interpolated voltage V<N+2> may be applied to the buffer 12, and the buffer 12 may drive the interpolated voltage V<N+2> to output as the source voltage Vout.

In order for the buffer 12 to output the interpolated voltage VG<N+3> as the source voltage Vout, the decoder 10 provides the first reference gamma voltage VG<N> to one transmission line Vin<3>, and provides the second reference gamma voltage VG<N+4> to three transmission lines Vin<2>, Vin<1> and Vin<0>. As a result, the interpolated voltage V<N+3> may be applied to the buffer 12, and the buffer 12 may drive the interpolated voltage V<N+3> to output as the source voltage Vout.

In the embodiment of FIGS. 8 and 9, the second gamma voltage may be driven to an interpolated voltage between the first and second reference gamma voltages in response to the high-order bits of the display data at the coarse phase, and the first gamma voltage may be driven to an interpolated voltage or the first gamma voltage having the target level in response to the lower-order bits of the display data at the fine phase.

More specifically, the decoder 10 sequentially performs the coarse phase and the fine phase.

The decoder 10 performs the coarse phase operation of providing the first reference gamma voltage V<N> and the second reference gamma voltage V<N+4> as a first combination to the transmission lines Vin<3:0> in response to the coarse data contained the display data DATA<7:0>, and applying an interpolated voltage between the first and second reference gamma voltages as the second gamma voltage to the buffer 12.

The first combination may be defined as a combination for a preset interpolated voltage. For example, when the interpolated voltage VG<N2+2> is set at the coarse phase, the first combination may be described as a combination for providing the first reference voltage VG<N> to two transmission lines Vin<3> and Vin<2> and providing the second reference gamma voltage VG<N+4> to two transmission lines Vin<1> and Vin<0>.

The interpolated voltage VG<M+2> which is selected to output the second gamma voltage set at the coarse phase may have the smallest delay time. Each of the four transmission lines Vin<3:0> has a unique delay time corresponding to an input voltage due to the influence of a parasitic capacitor. The delay time for each interpolated voltage may be decided by the mixed influence of parasitic capacitors in the four transmission lines Vin<3:0>. As a result, the interpolated voltage VG<N+2> among three interpolated voltages <VG<N+1>, VG<N+2> and VG<N+3> between the first reference gamma voltage VG<N> and the second reference gamma voltage VG<N+4> may have the smallest delay time. Furthermore, the interpolated voltage VG<N+2> may be used as the interpolated voltage for the coarse phase.

After the coarse phase operation, the decoder 10 performs the fine phase operation of providing the first reference gamma voltage VG<N> and the second reference gamma voltage VG<N+4> as a second combination to the transmission lines Vin<3:0> in response to the fine data contained in the display data DATA<7:0>, and applying the first gamma voltage to the buffer 12.

For the coarse phase, the decoder 10 may recognize the high-order bits DATA<7:2> as the coarse data. That is, the decoder 10 may recognize the coarse data DATA<7:2>, and select the interpolated voltage VG<N+2> as the second gamma voltage for the coarse phase. For the fine phase, the decoder 10 may recognize the low-order bits DATA<1:0> as the fine data. That is, the decoder 10 may recognize the fine data DATA<1:0> and select one of the first reference gamma voltage VG<N> and the interpolated voltages VG<N+1>, VG<N+2> and VG<N+3> as the first gamma voltage for the fine phase.

Thus, in order to generate the interpolated voltage VG<N+2> as the second gamma voltage corresponding to the coarse data DATA<7:2> when the display data DATA<7:0> are inputted, the decoder 10 outputs VG<N>, VG<N>, VG<N+4> and VG<N+4> to four transmission lines Vin<3:0>, and the buffer 12 drives and outputs the interpolated voltage VG<N+2> generated by the four inputs Vin<3:0>, that is, VG<N>, VG<N>, VG<N+4> and VG<N+4>. After a predetermined time has elapsed, the decoder 10 changes or retains the voltages of the four transmission lines Vin<3:0> in order to generate one of the first reference gamma voltage VG<N> and the interpolated voltages VG<N+1>, VG<N+

2> and VG<N+3> as the first gamma voltage corresponding to the fine data DATA<1:0>, and the buffer 12 drives the first gamma voltage generated by the four inputs Vin<3:0>, that is, VG<N>, VG<N>, VG<N+4> and VG<N+4>, and outputs the driven voltage as the source voltage Vout.

Therefore, in the embodiment of FIGS. 8 and 9, the decoder 10 can also sequentially perform the coarse phase and the fine phase, and reduce the delay time required for raising the first gamma voltage transmitted to the buffer 12 to the target level.

Figure 10:
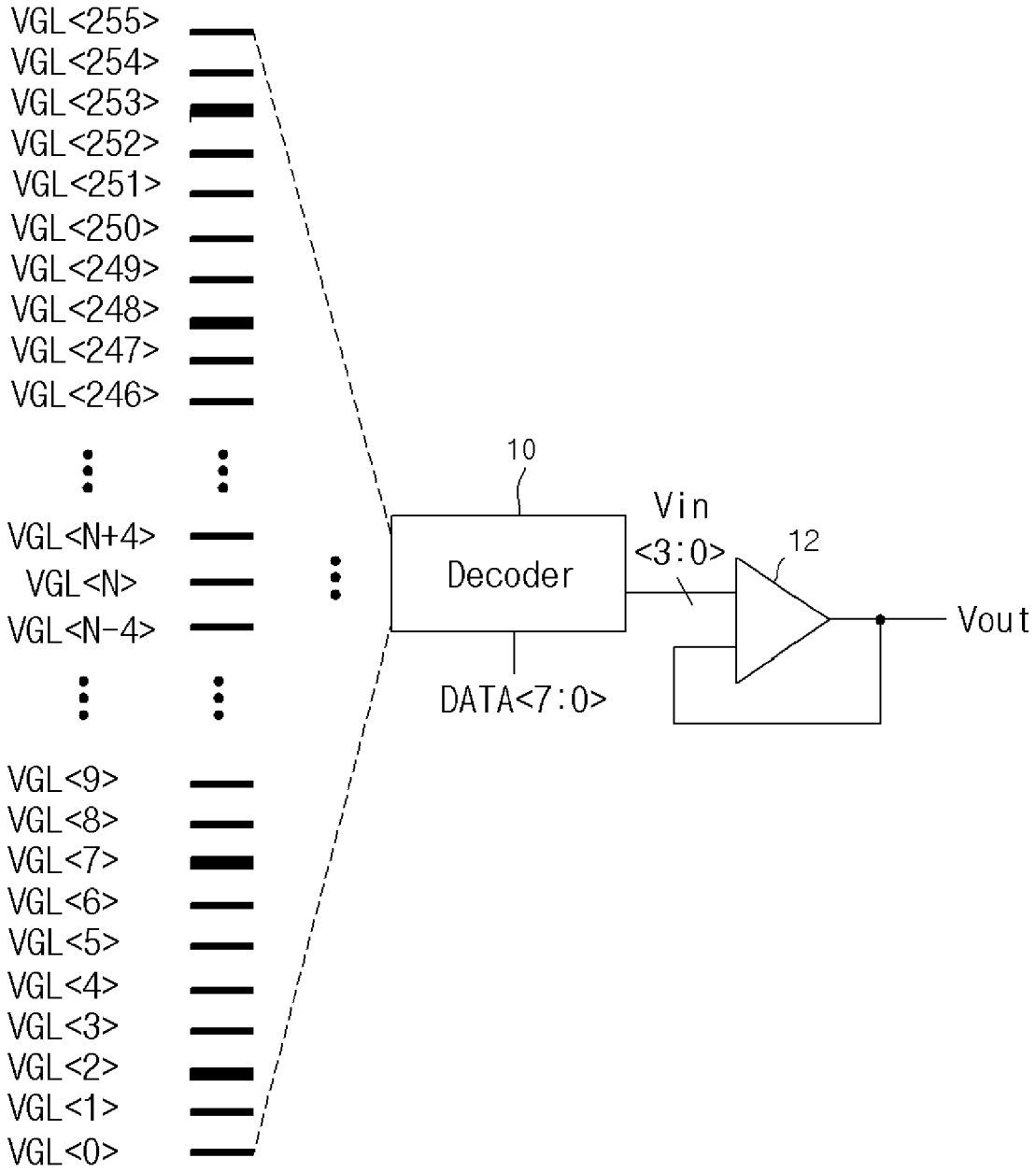
FIG. 10 is a circuit diagram illustrating a DAC of a source driving module according to still another embodiment of the present invention.
Figure 11:
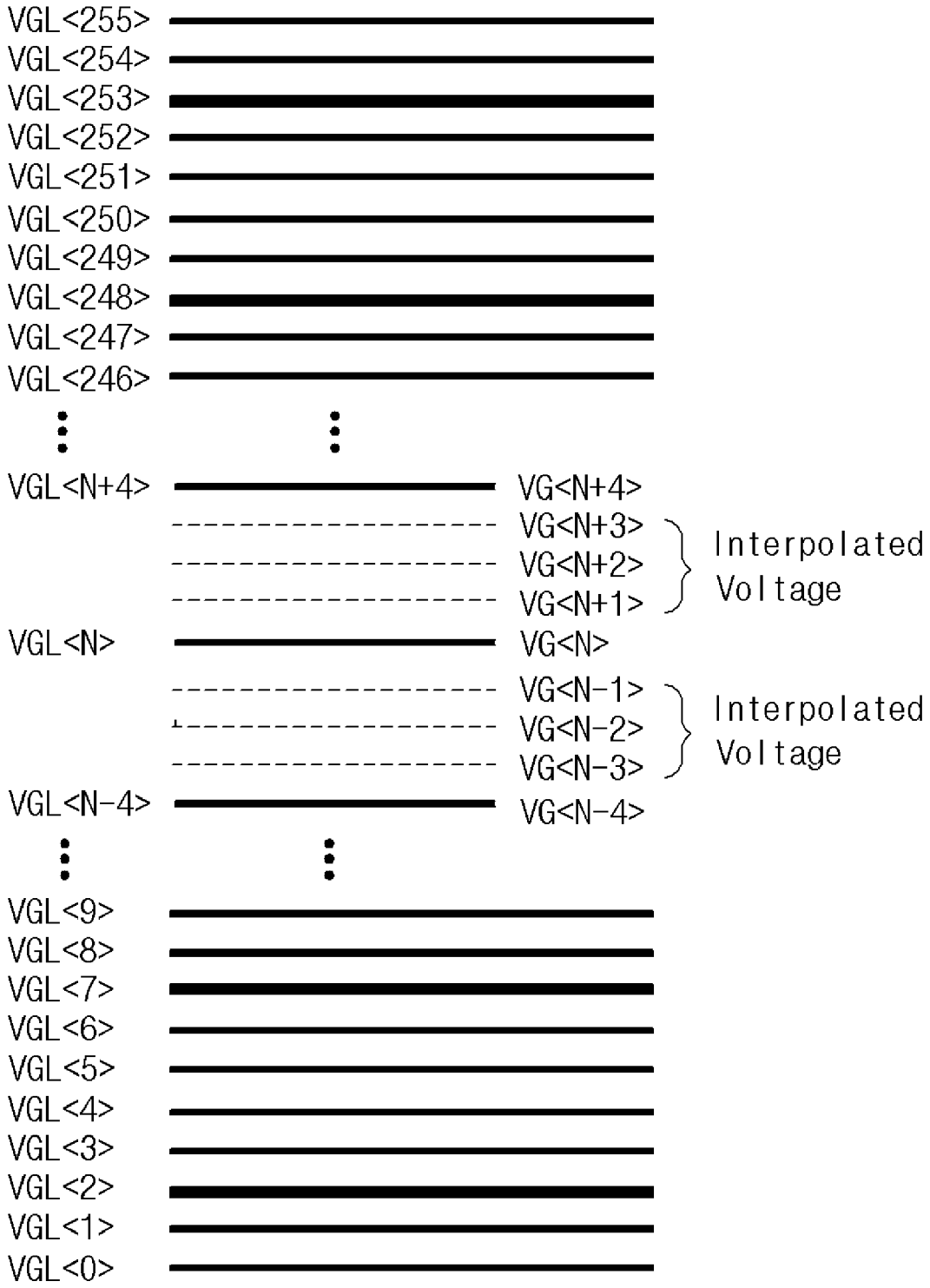
FIG. 11 is a diagram illustrating a layout of gamma lines applied to the embodiment of FIG. 10.

The embodiment of FIGS. 2 and 3 and the embodiment of FIGS. 8 and 9 may be merged into an embodiment of FIGS. 10 and 11.

For this embodiment, the decoder 10 is connected to a first group of gamma lines for providing gamma voltages corresponding to consecutive gray values in a first range and a second group of gamma lines for providing reference gamma voltages in a second range different from the first range, includes a plurality of transmission lines Vin<3:0>, and is configured to decide a first gamma voltage corresponding to display data DATA<7:0>.

The buffer 12 drives a first gamma voltage applied through the transmission lines Vin<3:0> and outputs the driven voltage as a source voltage Vout.

In the above-described configuration, the plurality of gamma lines included in the first range may be exemplified as VGL<255> to VGL<246> of FIGS. 10 and 11, and the gamma lines of the first group may be exemplified as VGL<255> to VGL<251>.

The second gamma line among the gamma lines VGL<255> to VGL<251> of the first group may be exemplified as VGL<253>. Since the gamma line VGL<253> has a larger line width than the other gamma lines of the first group, the gamma line VGL<253> has a smaller resistance value than the other gamma lines.

In the above-described configuration, the plurality of reference gamma lines included in the second range may be exemplified as the reference gamma lines VGL<N+4>, VGL<N> and VGL<N−4> of FIGS. 10 and 11, interpolated voltages between the gamma voltage VG<N+4> of the reference gamma line VGL<N+4> and the gamma voltage VG<N> of the reference gamma line VGL<N> may be represented by VG<N+3>, VG<N+2> and VG<N+1>, respectively, and interpolated voltages between the gamma voltage VG<N> of the reference gamma line VGL<N> and the gamma voltage VG<N−4> of the reference gamma line VGL<N−4> may be represented by VG<N−1>, VG<N−2> and VG<N−3>, respectively.

The decoder 10 drives the second gamma voltage by providing the second gamma voltage (for example, VG<253>) of the second gamma line (for example, VGL<253>) to the transmission lines Vin<3:0> in response to the display data DATA<7:0> corresponding to the first range, and then drives the first gamma voltage by providing the first gamma line of the first gamma line corresponding to the display data DATA<7:0> to the transmission lines Vin<3:0>, as in the embodiment of FIGS. 2 and 3.

Furthermore, the decoder 10 may decide the first gamma voltage by providing the first reference gamma voltage to the transmission lines Vin<3:0> or distributing and providing the first reference gamma voltage (for example, VG<N>) of the first reference gamma line (for example, VGL<N>) and the second reference gamma voltage (for example, VG<N+4>) of the second reference gamma line (for example, VGL<N+4>) having a higher gray level than the first reference gamma voltage to the transmission lines Vin<3:0>, in response to the display data DATA<7:0> corresponding to the second range, as in the embodiment of FIGS. 8 and 9.

The configuration and operation of the decoder 10, corresponding to the display data DATA<7:0> included in the first range, may be understood as the embodiment of FIGS. 2 and 3, and the configuration and operation of the decoder 10, corresponding to the display data DATA<7:0> included in the second range, may be understood as the embodiment of FIGS. 8 and 9. Therefore, the descriptions of the duplicated configurations and operations are omitted herein.

When the source driver and the DAC of the source driver according to the embodiments of the present invention are applied to a high-resolution display apparatus which requires a short driving time for each pixel or horizontal line, the source driver and the DAC can output the output signal Vout with a short delay time.

Furthermore, since the number of voltage lines for providing gamma voltages can be reduced, the chip size can be reduced to make it possible to provide convenience in designing a driving circuit.

While various embodiments have been described above, it will be understood to those skilled in the art that the embodiments described are by way of example only. Accordingly, the disclosure described herein should not be limited based on the described embodiments.

What is claimed:

1. A source driver for a display apparatus, comprising:

a decoder connected to a plurality of transmission lines and a plurality of reference gamma lines to provide reference gamma voltages, and configured to select one or more of a first reference gamma voltage and a second reference gamma voltage, which have adjacent gray levels among the reference gamma voltages, in response to display data, and distribute and provide the selected reference gamma voltages to the plurality of transmission lines, the second reference gamma voltage having a higher gray level than the first reference gamma voltage; and a buffer configured to drive a first gamma voltage corresponding to the average of the voltages provided to the plurality of transmission lines and output the driven voltage as a source voltage.

2. The source driver of claim 1, wherein the decoder gradually increases the number of transmission lines for outputting the second reference gamma voltage, with the increase in gray level of the first gamma voltage.

3. The source driver of claim 1, wherein the decoder performs a coarse phase operation of selecting one or more of the first and second reference gamma voltages and distributing and providing the selected reference gamma voltages to the plurality of transmission lines in response to coarse data contained in the display data, in order to drive the second gamma voltage to the buffer, and then performs a fine phase operation of selecting one or more of the first and second reference gamma voltages and distributing and providing the selected reference gamma voltages to the plurality of transmission lines in response to fine data contained in the display data, in order to drive the first gamma voltage to the buffer.

4. The source driver of claim 3, wherein the decoder recognizes a part of bits contained in the display data as the coarse data and recognizes the other bits as the fine data.

5. The source driver of claim 3, wherein the decoder performs the coarse phase operation to drive the second gamma voltage to the buffer, the second gamma voltage corresponding to an intermediate value between the first and second reference gamma voltages, and then performs the fine phase operation to drive the first gamma voltage to the buffer.

6. A source driver for a display apparatus, comprising:

a decoder connected to a first group of gamma lines to provide gamma voltages corresponding to consecutive gray values in a first range, a second group of reference gamma lines to provide reference gamma voltages in a second range different from the first range, and a plurality of transmission lines; and a buffer configured to drive first gamma voltage corresponding to the average of voltages provided to the plurality of transmission lines and output the driven voltage as a source voltage, wherein a second gamma line among the plurality of gamma lines in the first group has a larger line width than the other gamma lines and thus has a larger resistance value than the other gamma lines, and the decoder provides a second gamma voltage of the second gamma line to the plurality of transmission lines in response to the display data corresponding to the first range, and then provides the plurality of transmission lines with the gamma voltage of one gamma line among the first group of gamma lines corresponding to the display data, selects one or more of a first reference gamma voltage and a second reference gamma voltage, which have adjacent gray levels among the reference gamma voltages, in response to the display data corresponding to the second range, and distributes and provides the selected reference gamma voltages to the plurality of transmission lines, the second reference gamma voltage having a higher gray level than the first reference gamma voltage.

7. The source driver of claim 6, wherein the display data comprise coarse data and fine data, and the decoder selects the second gamma voltage of the second gamma line according to the coarse data of the display data corresponding to the first range, and provides the selected second gamma voltage to the plurality of transmission lines, and then selects the gamma voltage of one gamma line among the plurality of gamma lines according to the fine data of the display data corresponding to the first range, and provides the selected gamma voltage to the plurality of transmission lines.

8. The source driver of claim 6, wherein the display data comprise coarse data and fine data, and the decoder performs a coarse phase operation of selecting one of more of the first and second reference gamma voltages in response to the coarse data of the display data corresponding to the second range and distributing and providing the selected reference gamma voltages to the plurality of transmission lines, and then performs a fine phase operation of selecting one of more of the first and second reference gamma voltages in response to the fine data contained in the display data corresponding to the second range and distributing and providing the selected reference gamma voltages to the plurality of transmission lines.

9. The source driver of claim 8, wherein the decoder recognizes a part of bits contained in the display data as the coarse data, and recognizes the other bits as the fine data.

* * * * *